US006689237B1

(12) United States Patent
Mendenhall

(10) Patent No.: US 6,689,237 B1
(45) Date of Patent: Feb. 10, 2004

(54) GAS GENERANTS CONTAINING A TRANSITION METAL COMPLEX OF ETHYLENEDIAMINE 5,5'-BITETRAZOLE

(75) Inventor: Ivan V. Mendenhall, Providence, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 10/356,012

(22) Filed: Jan. 31, 2003

(51) Int. Cl.[7] ..... C06B 47/08; C06B 31/00
(52) U.S. Cl. ..... 149/36; 149/45
(58) Field of Search ..... 149/36, 45, 109.6; 280/741; 102/531; 60/205

(56) References Cited

U.S. PATENT DOCUMENTS 5,482,579 A 1/1996 Ochi et al.
6,156,137 A * 12/2000 Lundstrom et al. ..... 149/45
6,300,498 B1 * 10/2001 Tanaka et al. ..... 544/185

FOREIGN PATENT DOCUMENTS

| | | |
|---|---|---|
| JP | 100 72273 | 3/1998 |
| WO | 95/04016 | 2/1995 |

* cited by examiner

*Primary Examiner*—Michael J. Carone
*Assistant Examiner*—Aileen B. Felton
(74) *Attorney, Agent, or Firm*—James D. Erickson; Sally J. Brown

(57) ABSTRACT

Gas generant compositions which include at least one transition metal complex of ethylenediamine 5,5'-bitetrazole are provided to produce or results in compositions having relatively high burn rates. Also provided are corresponding or associated gas generating devices and inflatable vehicle occupant safety restraint systems and methods of gas generation.

36 Claims, 1 Drawing Sheet

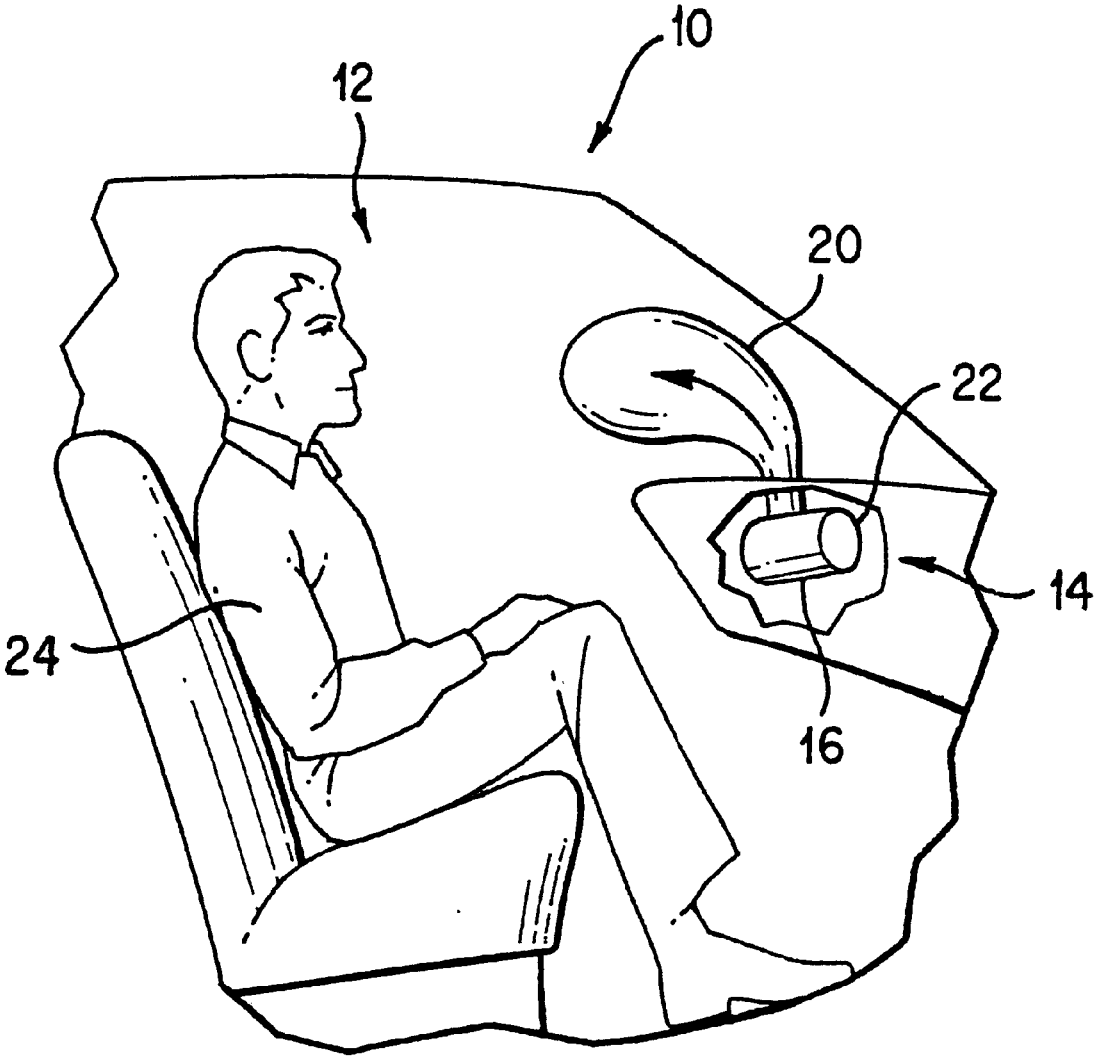
FIGURE

GAS GENERANTS CONTAINING A TRANSITION METAL COMPLEX OF ETHYLENEDIAMINE 5,5'-BITETRAZOLE

CROSS REFERENCE TO RELATED APPLICATION

This application is related to commonly assigned U.S. patent application Ser. No. 09/998,122 filed on Nov. 30, 2001. Application Ser. No. 09/998,122 is hereby incorporated by reference herein in its entirety and is made a part hereof, including, but not limited to, those portions that specifically appear herein.

BACKGROUND OF THE INVENTION

This invention relates generally to gas generant materials such as are used to inflate automotive inflatable restraint airbag cushions and, more particularly, to the enhancement of the rate at which such materials burn or otherwise react.

Gas generating materials are useful in a variety of different contexts. One significant use for such compositions is in the operation of automotive vehicle occupant restraints. For example, it is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated in a matter of no more than a few milliseconds with gas produced or supplied by a device commonly referred to as an "inflator." In practice, such an airbag cushion is desirably deployed into a location within the vehicle between the occupant and certain parts of the vehicle interior, such as a door, steering wheel, instrument panel or the like, to prevent or avoid the occupant from forcibly striking such part(s) of the vehicle interior.

Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as relating to the safe and effective handling, supply and disposal of such gas generant materials.

In view thereof, significant efforts have been directed to minimizing or avoiding the use of sodium azide in automotive airbag inflators. Through such efforts, various combinations of non-azide fuels and oxidizers have been proposed for use in gas generant compositions. These non-azide fuels are generally desirably less toxic to make and use, as compared to sodium azide, and may therefore be easier to dispose of and thus, at least in part, found more acceptable by the general public. Further, non-azide fuels composed of carbon, hydrogen, nitrogen and oxygen atoms typically yield all gaseous products upon combustion. As will be appreciated by those skilled in the art, fuels with high nitrogen and hydrogen contents and a low carbon content are generally attractive for use in such inflatable restraint applications due to their relatively high gas outputs (such as measured in terms of moles of gas produced per 100 grams of gas generant material).

Most oxidizers known in the art and commonly employed in such gas generant compositions are metal salts of oxygen-bearing anions (such as nitrates, chlorates and perchlorates, for example) or metal oxides. Unfortunately, upon combustion, the metallic components of such oxidizers typically end up as a solid compound, such as an oxide, and thus reduce the relative gas yields realizable therefrom. Consequently, the amounts of such oxidizers in a particular formulation typically affect the gas output or yield from the formulation. If oxygen is incorporated into the fuel material, however, less of such an oxidizer may be required and the gas output of the formulation can be increased.

In addition to low toxicity and high gas outputs, gas generant materials desirably are relatively inexpensive, thermally stable (i.e., desirably decompose only at temperatures greater than about 160° C.), and have a low affinity for moisture.

In addition to the above-identified desirable properties and characteristics, gas generant materials for use in automotive inflatable restraint applications must be sufficiently reactive such that upon the proper initiation of the reaction thereof, the resulting gas producing or generating reaction occurs sufficiently rapidly such that a corresponding inflatable airbag cushion is properly inflated so as to provide desired impact protection to an associated vehicle occupant. In general, the burn rate for a gas generant composition can be represented by the equation (1), below:

$$r_b=k(P)^n \tag{1}$$

where,

| | |
|---|---|
| $r_b$ = | burn rate (linear) |
| k = | constant |
| P = | pressure |
| n = | pressure exponent, where the pressure exponent is the slope of a linear regression line drawn through a log-log plot of burn rate versus pressure. |

Guanidine nitrate ($CH_6N_4O_3$) is a non-azide fuel with many of the above-identified desirable fuel properties. For example, guanidine nitrate is commercially available, relatively low cost, non-toxic, provides excellent gas output due to a high content of nitrogen, hydrogen and oxygen and a low carbon content and has sufficient thermal stability to permit spray-dry processing. In view thereof, guanidine nitrate has found wide utilized in the automotive airbag industry.

Unfortunately, guanidine nitrate suffers from a lower burn rate than may be desired in many applications. Thus, there remains a need and a demand for an azide-free gas generant material that may more effectively overcome one or more of the problems or shortcomings described above.

Commonly assigned U.S. patent application, Ser. No. 09/715,459, filed Nov. 17, 2000, relates generally to gas generant compositions which desirably include or contain guanylurea nitrate (also known as dicyandiamidine and amidinourea). In particular, guanylurea nitrate advantageously has a relatively high theoretical density such as to permit a relatively high loading density for a gas generant material that contains such a fuel component. Further, guanylurea nitrate exhibits excellent thermal stability, as evidenced by guanylurea nitrate having a thermal decomposition temperature of 216° C. In addition, guanylurea nitrate has a large negative heat of formation (i.e., –880 cal/gram) such as results in a cooler burning gas generant composition, as compared to an otherwise similar gas generant containing guanidine nitrate.

While the inclusion or use of guanylurea nitrate in gas generant materials can serve to avoid reliance on the inclusion or use of sodium azide or other similar azide materials while providing improved burn rates and overcoming one or more of the problems, shortcomings or limitations such as relating to cost, commercial availability, low toxicity, thermal stability and low affinity for moisture, even further improvement in the burn rate of gas generant formulations may be desired or required for particular applications.

For some inflator applications, a low gas generant formulation burn rate can be at least partially compensated for by reducing the size of the shape or form of the gas generant material such as to provide the gas generant material in a shape or form having a relatively larger reactive surface area. In practice, however, there are practical limits to the minimum size of the shape or form, such as a tablet, for example, to which gas generant materials can reproducibly be manufactured, and increased burn rates may be needed for particular applications which require a higher inflator performance.

The above-identified, co-pending, commonly assigned, U.S. patent application Ser. No. 09/998,122 filed on Nov. 30, 2001 teaches burn rate enhancement via the incorporation or use of a transition metal complex of diammonium bitetrazole. These compounds, when used as a part of a gas generant formulation, in conjunction with a primary fuel, such as guanidine nitrate, enhance burn rate. While such inclusion of a transition metal complex of diammonium bitetrazole may desirably serve to enhance the burn rate of a formulation, these compounds are relatively expensive due to the cost of the bitetrazole moieties.

Thus, there is a continuing need and demand for alternative and desirably lower cost non-azide based gas generant formulations having desirably increased or elevated burn rates as well as methods or techniques for increasing the burn rate of a gas generant formulation.

SUMMARY OF THE INVENTION

A general object of the invention is to provide an improved gas generant composition as well as either or both corresponding or associated methods of generating gas and methods for increasing the burn rate of a gas generant formulation.

A more specific objective of the invention is to overcome one or more of the problems described above.

The general object of the invention can be attained, at least in part, through a gas generant composition that includes an oxidizer component and a fuel component including a transition metal complex of ethylenediamine 5,5'-bitetrazole.

The prior art generally fails to provide desirably lower cost non-azide based gas generant formulations having desirably increased or elevated burn rates as well as methods or techniques for increasing the burn rate of a gas generant formulation, particularly a non-azide based gas generant formulation. In particular, the prior art generally fails to provide as effective as may be desired methods or techniques for the raising of the burn rate of a gas generant formulation, particularly a non-azide gas generant formulation, to a level sufficient and desired for vehicular inflatable restraint system applications and in a manner practical and appropriate for such applications. Further, the prior art also generally fails to provide corresponding or associated non-azide gas generant formulations that exhibit sufficiently and effectively elevated burn rates as may be desired for such vehicular inflatable restraint system applications.

The invention further comprehends a method for increasing the burn rate of a gas generant formulation, the method involving adding a quantity of at least one transition metal complex of ethylenediamine 5,5'-bitetrazole to the gas generant formulation.

The invention still further comprehends a method of generating gas, the method involving:

igniting a gas generant composition comprising a fuel component including a transition metal complex of ethylenediamine 5,5'-bitetrazole and an oxidizer component.

As used herein, references to a specific composition, component or material as a "fuel" are to be understood to refer to a chemical that generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

References to a component or material as a "burn rate catalyst," "burn rate enhancer" or the like are to be understood to refer to such a component or material, when added or included as a minor ingredient, i.e., typically in an amount of less than 20 weight percent and, more commonly, in an amount of less than 10 weight percent, produces or results in a significant effect on the burn rate of the composition in which the component or material has been added, where a significant effect on burn rate generally involves an increase in burn rate of at least about 20 percent. It will be understood that such burn rate catalyst or enhancer materials can and typically do undergo reaction when in normal use in a combustion reaction.

Guanylurea nitrate ($NH_2C(NH)NHC(O)NH_2.HNO_3$) is also commonly known as dicyandiamidine and amidinourea.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides an improved gas generant composition as well as methods for increasing the bum rate of a gas generant formulation and generating gas. As described in greater detail below and in accordance with one preferred embodiment of the invention, such improved gas generant composition desirably contains or includes a transition metal complex of ethylenediamine 5,5'-bitetrazole.

Suitable transition metals for use in the practice of the invention include copper, zinc, cobalt, iron, nickel and chromium. Preferably, the transition metal has a valence of +2. These complexes generally have an empirical formula of $M(C_2H_8N_2)_2C_2N_8$, where M is a transition metal of +2 valence. Preferred transition metals used in the practice of the invention include zinc and copper, with copper currently being a particularly preferred transition metal for such use as copper desirably forms copper metal whereas zinc may more likely form an oxide and thereby undesirably consume or use at least a portion of the gas generant oxidizer. Thus, a particularly preferred transition metal complex of ethylenediamine 5,5'-bitetrazole for use in the practice of the invention has an empirical formula of $Cu(C_2H_8N_2)_2C_2N_8$ and is believed to be copper bis ethylenediamine 5,5'-bitetrazole.

In specific preferred embodiments, the transition metal complex of ethylenediamine 5,5'-bitetrazole is present in the gas generant composition in a relative amount of between about 1 and about 100 wt. % of the fuel component of the gas generant formulation. In accordance with certain preferred embodiments, the transition metal complex of ethylenediamine 5,5'-bitetrazole is used as a burn rate enhancer in conjunction with a fuel material, sometimes hereinafter referred to as a "second" fuel material or a primary fuel or mixture or combination of primary fuel materials, in which the transition metal complex of ethylenediamine 5,5'-bitetrazole comprises between about 1 and about 25 wt. % of the fuel component of the gas generant formulation, the primary fuel or mixture or combination of primary fuels comprises between about 75 and about 99 wt. % of the fuel component of the gas generant formulation.

Those skilled in the art and guided by the teachings herein provided will appreciate that the invention can desirably be practiced via the inclusion of a sufficient quantity of at least one transition metal complex of ethylenediamine 5,5'-bitetrazole to a gas generant formulation having a primary fuel to effect a desirable increase in the burn rate exhibited by the resulting formulation, as compared to the same formulation without the inclusion of such transition metal complex of ethylenediamine 5,5'-bitetrazole. In general, however, it has been found preferable for a gas generant formulation in accordance with a preferred practice of the invention to include or incorporate the at least one transition metal complex of ethylenediamine 5,5'-bitetrazole in a relative amount of at least 5 wt. % and, more preferably, in a relative amount of at least 10 wt. % in order to provide gas generant formulations evidencing a sufficiently increased burn rate effective for such inflatable restraint system applications.

While the broader practice of the invention is not necessarily limited to the incorporation or use of such a transition metal complex of ethylenediamine 5,5'-bitetrazole in combination or conjunction with particular or specific gas generant formulations, the invention is believed to have particular benefit or utility in gas generant formulations that contain or include guanidine nitrate, hexammine cobalt III nitrate, copper bis-guanylurea dinitrate or a combination thereof as a primary fuel and a primary oxidizer selected from the group consisting of ammonium nitrate; basic metal nitrates such as basic copper nitrate (bCN), basic zinc nitrate and combinations thereof, for example; copper diammine dinitrate and combinations of two or more of such oxidizer materials. For example, one preferred gas generant formulation for the incorporation or use of such a transition metal complex of ethylenediamine 5,5'-bitetrazole in accordance with the invention includes ammonium nitrate as a primary oxidizer and copper bis guanylurea dinitrate as a primary fuel. In accordance with certain preferred embodiments of the invention, the oxidizer component includes at least one basic metal nitrate such as basic copper nitrate (bCN), basic zinc nitrate and combinations thereof Thus, one preferred gas generant formulation for the incorporation or use of such a transition metal complex of ethylenediamine 5,5'-bitetrazole in accordance with the invention includes basic copper nitrate as a primary oxidizer and guanidine nitrate as a primary fuel. Another preferred gas generant formulation for the incorporation or use of such a transition metal complex of ethylenediamine 5,5'-bitetrazole in accordance with the invention includes hexammine cobalt III nitrate (HACN) and guanidine nitrate as fuels. Thus, basic metal nitrates are a preferred oxidizer in combination with fuels and fuel combinations of the present invention. However, gas generant compositions in accordance with the invention may utilize a wide variety of oxidizers including alkali metal, alkaline earth metal, and ammonium salts of nitrates and perchlorates, transition metal oxides and hydroxides, basic metal nitrate salts (e.g., basic copper nitrate, basic zinc nitrate, etc.), basic metal carbonates, and transition metal complexes of ammonium nitrate and combinations thereof. Generally, the fuel and oxidizer are used at near stoichiometric relative amounts, i.e., within about 20 mole percent either side of stoichiometric equivalence.

Those skilled in the art and guided by the teachings herein provided will further appreciate that a gas generant composition or formulation in accordance with the invention may also contain other components such as known in the art, such as those used for slag formation, e.g., silica, alumina and other refractory oxides, and processing aids.

Those skilled in the art and guided by the teachings will further appreciate that various procedures or reaction schemes can be employed in the preparation of a transition metal complex of ethylenediamine 5,5'-bitetrazole in accordance with the invention. A currently preferred route for synthesizing the copper complex of ethylenediamine 5,5'-bitetrazole is by reacting copper bitetrazole (produced by reacting cupric oxide or copper carbonate with bitetrazole) with ethylenediamine. Generally the complex is recovered as a monohydrate. The reaction to form the complex is:

$$Cu(C_2N_8).2H_2O(\text{copper bitetrazole})+C_2H_8N_2\ (\text{ethylenediamine})\rightarrow Cu(C_2H_8N_2)_2C_2N_8H_2O+H_2O.$$

TABLE 1, below, lists certain select properties of the copper complex of diammonium 5,5'-bitetrazole in accordance with the invention.

TABLE 1

| PROPERTY | VALUE |
|---|---|
| Thermal onset of decomposition | 275°–300° C. |
| Color | blue/purple powder |
| Water solubility | soluble |
| Content | (mass percent) |
| copper | 18.18 |
| carbon | 21.21 |
| hydrogen | 4.99 |
| nitrogen | 51.80 |

As will be appreciated, gas generant compositions or materials prepared in accordance with the invention can be incorporated, utilized or practiced in conjunction with a variety of different structures, assemblies and systems. As representative, the FIGURE illustrates a vehicle 10 having an interior 12 wherein is positioned an inflatable vehicle occupant safety restraint system, generally designated by the reference numeral 14. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition or formulation in accordance with the invention and such as suited, upon ignition, to produce or form a quantity of gas such as to be used in the inflation the inflatable vehicle occupant restraint 20. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

Preparation of Copper Ethylenediamine 5,5'-Bitetrazole (Lab Scale).

Bitetrazole dihydrate (50.95 grams) was partially dissolved in a beaker containing 200 ml of water. Basic copper carbonate (32.75 grams) was added and the temperature of the slurry was equilibrated at 190° F. (88° C.) and held at that temperature until the reaction was completed (approximately 1 hour). Ethylenediamine (35.55 grams) was then added gradually to the beaker contents and the complex (100 grams) formed immediately

Example 2

Preparation of Copper Ethylenediamine 5,5'-Bitetrazole (10 Pounds).

A 10 pound sample of copper ethylenediamine 5,5'-bitetrazole can be prepared by charging a spray-dry mix tank with water (9080 ml). Bitetrazole dihydrate (2313.4 grams) can then be added to the spray-dry mix tank and partially dissolves. Basic copper carbonate (1486.85 grams) can then be added to the contents of the spray-dry mix tank and the temperature of the slurry can be equilibrated at 190° F. (88° C.) and held at that temperature until the reaction is complete (approximately 1 hour). Ethylenediamine can then be added gradually to the spray-dry mix tank contents and the complex will form immediately.

Example 3 and Comparative Examples 1 and 2

Basic copper nitrate oxidized gas generant compositions containing guanidine nitrate and copper diammine 5,5'-bitetrazole as co-fuels (Example 3); containing guanidine nitrate alone as the fuel (Comparative Example 1); and containing guanidine nitrate and copper bis ethylenediamine 5,5'-bitetrazole as co-fuels (Comparative Example 2), as shown in TABLE 2, below, were prepared. The values shown in TABLE 2 are in terms of composition weight percentages.

TABLE 2

| Ingredient | Example 3 | COMPARATIVE EXAMPLE 1 | COMPARATIVE EXAMPLE 2 |
|---|---|---|---|
| Basic copper nitrate | 60.34 | 47.33 | 51.05 |
| Guanidine nitrate | 28.16 | 51.17 | 37.45 |
| Alumina | 1.50 | 1.50 | 1.50 |
| Copper bis ethylenediamine 5,5'-bitetrazole | 10.00 | — | — |
| Copper diammine 5,5'-bitetrazole | — | — | 10.00 |

The gas generant compositions of each of Example 3 and Comparative Examples 1 and 2 were then tested. The burn rate and density (ρ) values identified in TABLE 3 below were obtained. In particular, the burn rate data was obtained by first pressing samples of the respective gas generant formulations into the shape or form of a 0.5 inch diameter cylinder using a hydraulic press (12,000 lbs. force). Typically enough powder was used to result in a cylinder length of 0.5 inch. The cylinders were then each coated on all surfaces except the top surface with a krylon ignition inhibitor to help ensure a linear burn in the test fixture. In each case, the so coated cylinder was placed in a 1-liter closed vessel or bomb capable of being pressurized to several thousand psi with nitrogen and equipped with a pressure transducer for accurate measurement of bomb pressure. A small sample of igniter powder was placed on top of the cylinder and a nichrome wire was passed through the igniter powder and connected to electrodes mounted in the bomb lid. The bomb was then pressurized to the desired pressure and the sample ignited by passing a current through the nichrome wire. Pressure vs. time data was collected as each of the respective samples were burned. Since combustion of each of the samples generated gas, an increase in bomb pressure signaled the start of combustion and a "leveling off" of pressure signaled the end of combustion. The time required for combustion was equal to $t_2-t_1$ where $t_2$ is the time at the end of combustion and $t_1$ is the time at the start of combustion. The sample length was divided by combustion time to give a burning rate in inches per second. Burning rates were typically measured at four pressures (900, 1350, 2000, and 3000 psi). The log of burn rate vs. the log of average pressure was then plotted. From this line the burn rate at any pressure can be calculated using the gas generant composition burn rate equation (1), identified above.

TABLE 3

| PARAMETER | Example 3 | COMPARATIVE EXAMPLE 1 | COMPARATIVE EXAMPLE 2 |
|---|---|---|---|
| $r_b$ | 0.65 | 0.39 | 0.53 |
| n | 0.33 | 0.36 | 0.32 |
| k | 0.068 | 0.033 | 0.059 |
| ρ (g/cc) | 2.18 | 1.89 | 2.06 |

where, $r_b$ = burn rate at 1000 psi in inch per second (ips);
n = pressure exponent in the burn rate equation (1) identified above, where the pressure exponent is the slope of the plot of the log of pressure along the x-axis versus the log of the burn rate along the y-axis; and
k = the constant in the burn rate equation (1) identified above.

Discussion of Results

As shown in TABLE 3, the gas generant composition of Example 3, which gas generant composition contained the copper complex of ethylenediamine 5,5'-bitetrazole in accordance with the practice of the invention, experienced a significantly increased burn rate ($r_b$) as compared to the gas generant composition of Comparative Example 1 which did not include any burn rate enhancer, and even compared to the gas generant composition of Comparative Example 2 containing copper complex of diammine 5,5'-bitetrazole, described in the above-identified commonly assigned U.S. patent application Ser. No. 09/998,122 filed on Nov. 30, 2001.

Further, the gas generant composition of Example 3 exhibited a lesser or reduced pressure sensitivity as compared to the gas generant composition of Comparative Example 1, as evidenced by the lower or decreased pressure exponent (n) obtained therewith, and a pressure sensitivity comparable to the gas generant composition of Comparative Example 2.

Example 4 and Comparative Examples 3 and 4

Basic copper nitrate oxidized gas generant compositions containing hexammine cobalt III nitrate and copper bis ethylenediamine 5,5'-bitetrazole as co-fuels (Example 4); containing hexammine cobalt III nitrate alone as the fuel (Comparative Example 3); and containing hexammine cobalt III nitrate and copper diammine 5,5'-bitetrazole as co-fuels (Comparative Example 4), as shown in TABLE 4, below, were prepared. The values shown in TABLE 4 are again in terms of composition weight percentages.

TABLE 4

| Ingredient | Example 4 | COMPARATIVE EXAMPLE 3 | COMPARATIVE EXAMPLE 4 |
|---|---|---|---|
| Basic copper nitrate | 23.14 | 21.50 | 22.53 |
| Hexammine cobalt III nitrate | 66.88 | 73.50 | 67.47 |
| Guar Gum | — | 5.00 | — |
| Copper bis ethylenediamine 5,5'-bitetrazole | 10.00 | — | — |
| Copper diammine 5,5'-bitetrazole | — | — | 10.00 |

The gas generant compositions of each of Example 4 and Comparative Examples 3 and 4 were then tested in a manner similar to that described above relative to Example 2 and Comparative Examples 1 and 2. The burn rate and density (ρ) values identified in TABLE 5 below were obtained.

TABLE 5

| PARAMETER | Example 4 | COMPARATIVE EXAMPLE 3 | COMPARATIVE EXAMPLE 4 |
|---|---|---|---|
| $r_b$ | 0.70 | 0.25 | 0.38 |
| n | 0.43 | 0.46 | 0.42 |
| k | 0.036 | 0.010 | 0.021 |
| 92 (g/cc) | 1.97 | 1.95 | 1.97 |

where,

| | |
|---|---|
| $r_b$ = | burn rate at 1000 psi in inch per second (ips); |
| n = | pressure exponent in the burn rate equation (1) identified above, where the pressure exponent is the slope of the plot of the log of pressure along the x-axis versus the log of the burn rate along the y-axis; and |
| k = | the constant in the burn rate equation (1) identified above. |

Discussion of Results

As shown in TABLE 5, the gas generant composition of Example 4, which gas generant composition contained the copper complex of ethylenediamine 5,5'-bitetrazole in accordance with the practice of the invention, experienced a very significantly increased burn rate ($r_b$) as compared to the gas generant composition of Comparative Example 3 which did not include any burn rate enhancing co-fuel, and even compared to the gas generant composition of Comparative Example 4 containing copper complex of diammine 5,5'-bitetrazole, described in the above-identified commonly assigned U.S. patent application Ser. No. 09/998,122 filed on Nov. 30, 2001.

Further, the gas generant composition of Example 4 exhibited a lesser or reduced pressure sensitivity as compared to the gas generant composition of Comparative Example 3, as evidenced by the lower or decreased pressure exponent (n) obtained therewith, and only slightly higher than that obtained with the gas generant composition of Comparative Example 4.

In view of the above, it is to be appreciated that the invention provides an effective method or technique for desirably raising or increasing of the bum rate of a gas generant formulation, particularly a non-azide gas generant formulation, to a level sufficient and desired for vehicular inflatable restraint system applications and in a manner practical and appropriate for such applications. Further, the invention also provides corresponding or associated non-azide gas generant formulations which exhibit sufficiently and effectively elevated burn rates as may be desired for such vehicular inflatable restraint system applications.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generant composition comprising:

an oxidizer component and a fuel component including a transition metal complex of ethylenediamine 5,5'-bitetrazole.

2. The gas generant composition of claim 1 wherein the transition metal complex of ethylenediamine 5,5'-bitetrazole includes a metal selected from the group consisting of copper, zinc, cobalt, iron, nickel, chromium, and combinations thereof.

3. The gas generant composition of claim 1 wherein the transition metal complex of ethylenediamine 5,5'-bitetrazole is a copper complex of ethylenediamine 5,5'-bitetrazole.

4. The gas generant composition of claim 3 wherein the copper complex of ethylenediamine 5,5'-bitetrazole is formed by reacting copper bitetrazole with ethylenediamine.

5. The gas generant composition of claim 3 wherein the copper complex of ethylenediamine 5,5'-bitetrazole has an empirical formula of $Cu(C_2H_8N_2)_2C_2N_8$.

6. The gas generant composition of claim 1 wherein said fuel component comprises between 1 and 100 wt. % of the transition metal complex of ethylenediamine 5,5'-bitetrazole and between 0 and 99 wt. % of a second fuel material, where the weight percentages are based on total weight of said fuel component.

7. A gas generating device containing the gas generant composition of claim 6.

8. An inflatable vehicle occupant safety restraint system comprising:

the gas generating device of claim 7 connected in association with an inflatable airbag cushion for inflating the airbag cushion.

9. The gas generant composition of claim 1 wherein said fuel component comprises between 1 and 25 wt. % of the transition metal complex of ethylenediamine 5,5'-bitetrazole and between 75 and 99 wt. % of a second fuel material, where the weight percentages are based on total weight of said fuel component.

10. The gas generant composition of claim 9 wherein the second fuel material comprises a member selected from the group consisting of guanidine nitrate, hexammine cobalt III nitrate, copper bis guanylurea dinitrate and combinations thereof.

11. The gas generant composition of claim 9 wherein the second fuel material comprises hexammine cobalt III nitrate.

12. A gas generating device containing the gas generant composition of claim 9.

13. An inflatable vehicle occupant safety restraint system comprising:

the gas generating device of claim 12 connected in association with an inflatable airbag cushion for inflating the airbag cushion.

14. The gas generant composition of claim 1 wherein said oxidizer component comprises an oxidizer selected from the group consisting of alkali metal, alkaline earth metal, and ammonium salts of nitrates and perchlorates; transition metal salts of oxides and hydroxides, basic metal carbonates; transition metal complexes of ammonium nitrate; basic metal nitrates and combinations thereof.

15. The gas generant composition of claim 1 wherein said oxidizer component comprises at least one basic metal nitrate.

16. The gas generant composition of claim 15 wherein the at least one basic metal nitrate is selected from the group consisting of basic copper nitrate, basic zinc nitrate and combinations thereof.

17. The gas generant composition of claim 9 wherein said gas generant composition has an increased burn rate as compared to the same gas generant composition without the transition metal complex of ethylenediamine 5,5'-bitetrazole.

18. The gas generant composition of claim 17 wherein the transition metal complex of ethylenediamine 5,5'-bitetrazole includes a metal selected from the group consisting of copper, zinc, cobalt, iron, nickel, chromium, and combinations thereof.

19. The gas generant composition of claim 17 wherein the transition metal complex of ethylenediamine 5,5'-bitetrazole is a copper complex of ethylenediamine 5,5'-bitetrazole.

20. The gas generant composition of claim 19 wherein the copper complex of ethylenediamine 5,5'-bitetrazole is formed by reacting copper bitetrazole with ethylenediamine.

21. The gas generant composition of claim 19 wherein the copper complex of ethylenediamine 5,5'-bitetrazole has an empirical formula of $Cu(C_2H_8N_2)_2C_2N_8$.

22. The gas generant composition of claim 9 wherein the oxidizer component comprises an oxidizer selected from the group consisting of alkali metal, alkaline earth metal, and ammonium salts of nitrates and perchlorates; transition metal salts of oxides and hydroxides, basic metal carbonates; transition metal complexes of ammonium nitrate; basic metal nitrates and combinations thereof.

23. The gas generant composition of claim 9 wherein the oxidizer component comprises at least one basic metal nitrate.

24. The gas generant composition of claim 23 wherein the at least one basic metal nitrate is selected from the group consisting of basic copper nitrate, basic zinc nitrate and combinations thereof.

25. A method of generating gas, said method comprising: igniting the gas generant composition of claim 1.

26. The method of claim 25 wherein the transition metal complex of ethylenediamine 5,5'-bitetrazole includes a metal selected from the group consisting of copper, zinc, cobalt, iron, nickel, chromium, and combinations thereof.

27. The method of claim 25 wherein the transition metal complex of ethylenediamine 5,5'-bitetrazole is a copper complex of ethylenediamine 5,5'-bitetrazole.

28. The method of claim 27 wherein the copper complex of ethylenediamine 5,5'-bitetrazole is formed by reacting copper bitetrazole with ethylenediamine.

29. The method of claim 27 wherein the copper complex of ethylenediamine 5,5'-bitetrazole has an empirical formula of $Cu(C_2H_8N_2)_2C_2N_8$.

30. The method of claim 25 wherein the fuel component comprises between 1 and 100 wt. % of the transition metal complex of ethylenediamine 5,5'-bitetrazole and between 0 and 99 wt. % of a second fuel material, where the weight percentages are based on total weight of the fuel component.

31. The method of claim 25 wherein the fuel component comprises between 1 and 25 wt. % of the transition metal complex of ethylenediamine 5,5'-bitetrazole and between 75 and 99 wt. % of a second fuel material, where the weight percentages are based on total weight of the fuel component.

32. The method of claim 31 wherein the second fuel material comprises a member selected from the group consisting of guanidine nitrate, hexammine cobalt III nitrate, copper bis guanylurea dinitrate and combinations thereof.

33. The method of claim 31 wherein the second fuel material comprises hexammine cobalt III nitrate.

34. The method of claim 25 wherein the oxidizer component comprises an oxidizer selected from the group consisting of alkali metal, alkaline earth metal, and ammonium salts of nitrates and perchlorates; transition metal salts of oxides and hydroxides, basic metal carbonates; transition metal complexes of ammonium nitrate; basic metal nitrates and combinations thereof.

35. The method of claim 25 wherein the oxidizer component comprises at least one basic metal nitrate.

36. The method of claim 35 wherein the at least one basic metal nitrate is selected from the group consisting of basic copper nitrate, basic zinc nitrate and combinations thereof.

* * * * *